US011808416B1

(12) United States Patent
Chen

(10) Patent No.: US 11,808,416 B1
(45) Date of Patent: Nov. 7, 2023

(54) DECORATIVE LIGHTING STRING WITH VERTICALLY OFFSET LIGHTING STRUCTURE

(71) Applicant: Willis Electric Co., Ltd., Taipei (TW)

(72) Inventor: Johnny Chen, Taipei (TW)

(73) Assignee: WILLIS ELECTRIC CO. LTD, Taipei (TW)

( * ) Notice: Subject to any disclaimer, the term of this patent is extended or adjusted under 35 U.S.C. 154(b) by 0 days.

(21) Appl. No.: 18/168,796

(22) Filed: Feb. 14, 2023

Related U.S. Application Data

(60) Provisional application No. 63/309,678, filed on Feb. 14, 2022.

(51) Int. Cl.
*F21S 4/10* (2016.01)
*F21V 21/002* (2006.01)
*F21Y 115/10* (2016.01)

(52) U.S. Cl.
CPC ..... *F21S 4/10* (2016.01); *F21V 21/002* (2013.01); *F21Y 2115/10* (2016.08)

(58) Field of Classification Search
CPC ..... F21S 4/10; F21V 21/002; F21Y 2115/10
See application file for complete search history.

(56) References Cited

U.S. PATENT DOCUMENTS 10,845,036 B2 * 11/2020 Shao ..... F21S 4/26
11,378,238 B2 * 7/2022 Chen ..... F21V 23/001
2005/0063181 A1 * 3/2005 Chiba ..... F21S 43/195 362/640
2006/0221609 A1 * 10/2006 Ryan ..... F21K 9/00 362/800
2016/0341408 A1 * 11/2016 Altamura ..... F21V 19/001

* cited by examiner

*Primary Examiner* — Evan P Dzierzynski
(74) *Attorney, Agent, or Firm* — Christensen, Fonder, Dardi & Herbert PLLC

(57) ABSTRACT

A lighting structure, including: a first conductor having a first insulated portion, a second insulation portion and a first conductor portion therebetween, the first conductor portion being bent so as to form a first horizontal portion and two first vertical portions; a second conductor having a first insulated portion, a second insulation portion and a second conductor portion therebetween, the second conductor portion being bent so as to form a first horizontal portion and two first vertical portions; an LED assembly connected to the first horizontal portions of the first and second conductors; a transparent adhesive covering the LED assembly and the first conductor portions of the first and second conductors; and a light-transmitting cap covering the LED assembly and the first horizontal portions of the first and second conductors.

2 Claims, 18 Drawing Sheets

DECORATIVE LIGHTING STRING WITH VERTICALLY OFFSET LIGHTING STRUCTURE

CROSS-REFERENCE TO RELATED APPLICATIONS

This application claims the benefit of U.S. Provisional Patent Application No. 63/309,678, filed Feb. 14, 2022, which is incorporated herein in their entirety.

FIELD OF THE INVENTION

This disclosure relates to a lighting string, and more particularly relates to a decorative lighting string with offset lighting structure.

BACKGROUND

A known lighting string is a configuration wherein a plurality of light sources are directly soldered on a wire in a spaced manner to form a string-shaped illumination device without a lamp holder in the art. For small light sources, such as bulbs and light emitting diodes (LEDs), it is a frequently used configuration. The lighting string may be easily configured into any form due to the maintenance of an original winding characteristic of the wire, so as to be suitable for special lighting needs or decorations.

In the art, the LED is directly soldered onto a wire after an insulating layer of the wire is directly removed. The electrode of the light emitting diode is directly soldered on an exposed metal core, and then solder joints are subjected to an insulating process. In the case where a light-transmitting cap is provided, the light-transmitting cap is fixed on a light source in an adhering manner. When the lighting string is bent considerably, a soldered portion will be also bent sharply. However, the solder usually lacks flexible or bendable properties, so that when the wire is bent significantly, the soldering joint easily fails, which makes the LED fail to emit light.

SUMMARY

In view of the above problem, this disclosure provides an embodiment of a lighting string package structure that does not require bending of the wires, and also provides another embodiment with wires that are bent in a particular manner that does not cause solder breakage, and moves the light source further upward in a light cap, so as to improve the lighting effect.

In a first embodiment, this disclosure provides a lighting string package structure, including a light-transmitting cap, a wire, a light emitting diode and a transparent encapsulating or adhering substance such as an adhesive, epoxy or glue. In an embodiment, the light-transmitting cap includes a body, two guide pieces and two lugs. The interior of the body is hollow, and an opening is formed in the bottom surface of the body to communicate with the interior of the body. The two guide pieces are in parallel and protrude from the bottom of the body. A guide trench is defined between the two guide pieces, and the opening is located between the two guide pieces. The wire has a soldering section with an exposed metal core. The two lugs inversely extend outward from the edge of the bottom of the body, and correspond to two ends of the guide trench. The light emitting diode has a light emitting surface and a soldering surface. The soldering surface is soldered onto the soldering section, and the soldering section is flatly attached to the soldering surface. The transparent glue covers the soldering section to adhere the soldering section to the guide trench and the two lugs, and extends around to wrap the light emitting surface of the light emitting diode. The light-transmitting cap covers the light emitting diode, so that the light emitting diode is located at the opening, and the light emitting surface faces the interior of the body. The soldering section is located between the two guide pieces, and the transparent glue attaches the light emitting diode to the light-transmitting cap.

In one or more embodiments, other portions of the wire are covered by an insulating layer.

In one or more embodiments, the insulating layer is a plastic layer or insulating paint coating layer.

In one or more embodiments, a distance between two ends of the two lugs is equal to or greater than a length of the soldering section.

In one or more embodiments, the transparent glue attaches the soldering section to the two guide pieces and the edge of the opening.

In one or more embodiments, the transparent glue is an ultraviolet-curable adhesive.

By adopting the lighting string package structure, in addition to providing an optical effect through the light-transmitting cap, the fixing of the soldering section can be reinforced, thereby avoiding a soldering failure of the light emitting diode due to excessive bending of the soldering section in a use process of a lighting string.

Another embodiment of the disclosure comprises a vertically-offset lighting structure for a light string that includes: a first conductor having a first insulated portion, a second insulation portion and a first conductor portion therebetween, the first conductor portion being bent so as to form a first horizontal portion and two first vertical portions; a second conductor having a first insulated portion, a second insulation portion and a second conductor portion therebetween, the second conductor portion being bent so as to form a first horizontal portion and two first vertical portions; an LED assembly connected to the first horizontal portions of the first and second conductors; a transparent adhesive covering the LED assembly and the first conductor portions of the first and second conductors; and a light-transmitting cap covering the LED assembly and the first horizontal portions of the first and second conductors.

An embodiment of the disclosure also includes a light string comprising a plurality of vertically-offset lighting structures.

DETAILED DESCRIPTION

Figure 1:
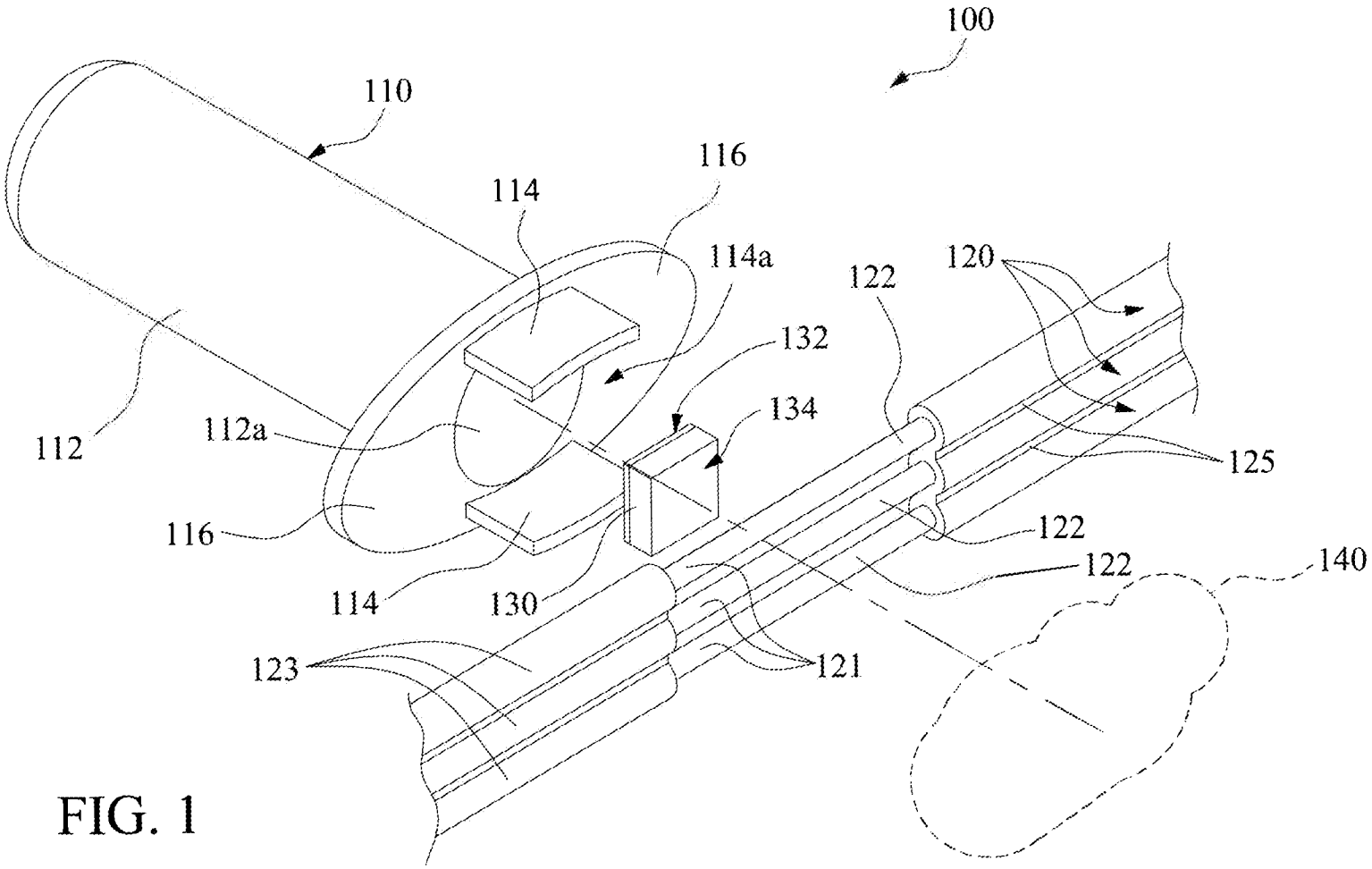
FIG. 1 is a three-dimensional exploded diagram of an embodiment of this disclosure.
Figure 2:
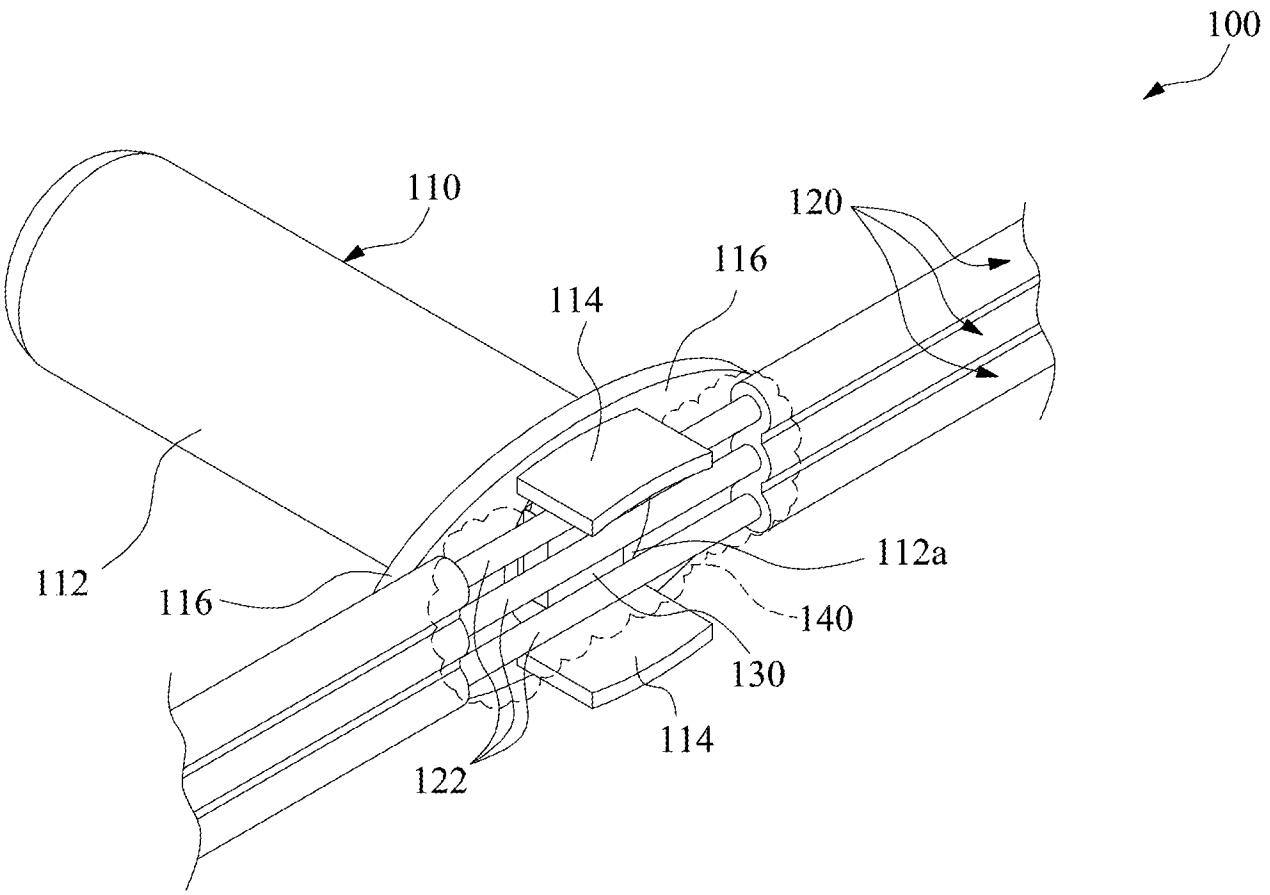
FIG. 2 is a three-dimensional diagram of an embodiment of this disclosure.
Figure 3:
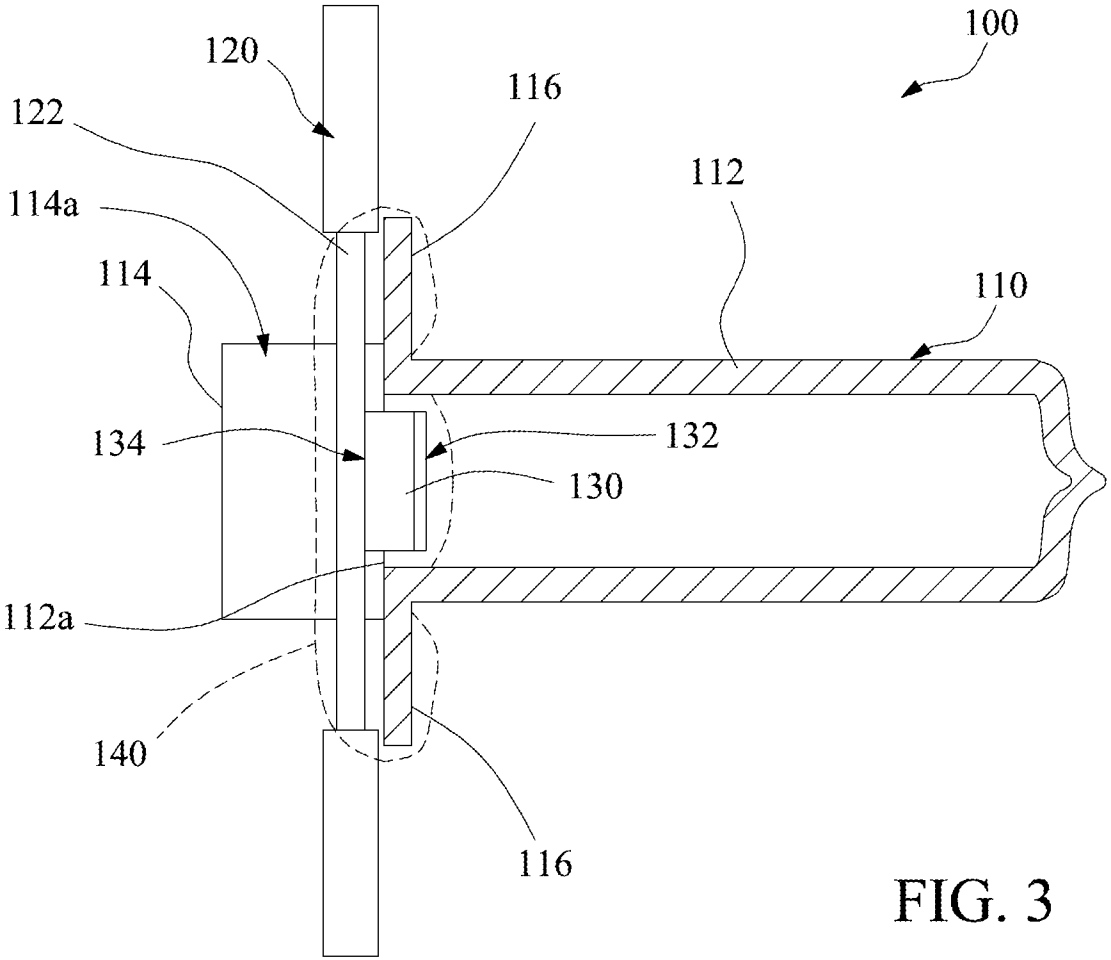
FIG. 3 is a cross-sectional schematic diagram of an embodiment of this disclosure.

Referring to FIG. 1, FIG. 2 and FIG. 3, a lighting string package assembly or lighting structure 100 disclosed by an embodiment of this disclosure is illustrated, and is used as one portion of a lighting string. The lighting string package structure 100 includes a light-transmitting cap 110, one or more wires 120, a light emitting diode 130 (LED 130) and a transparent adhesive 140.

As shown in FIG. 1, FIG. 2 and FIG. 3, the light-transmitting cap 110 is made of a light-transmitting material that may be transparent and colorless, or may be in any color to provide illuminating light in different colors. The light-transmitting cap 110 includes a body 112 and two guide pieces 114. The top of the body 112 may be in a lens form, and is used for refracting light to form a light condensation or scattering effect. The interior of the body 112 is hollow, and an opening 112*a* is formed in the bottom surface of the body 112 to communicate with the interior of the body 112.

As shown in FIG. 1, FIG. 2 and FIG. 3, the number of wires 120 may be in any quantity, and the quantity is determined according to an electric connection mode of the LED 130. In case of a series circuit, there may be only one wire 120, and two ends of the wire 120 are respectively connected to a power source and the ground. In case of a parallel circuit, there may be two wires 120: a power wire for supplying power and a ground wire. However, other electrical connection modes are not excluded. For example, when a programmable-controlled LED 130 is used, there will be a third wire 120 serving as a transmission line of a control signal. FIG. 1, FIG. 2 and FIG. 3 depict a 3-wire embodiment.

As shown in FIG. 1, FIG. 2 and FIG. 3, each wire 120 includes a conductor portion 121 and an insulating layer 123. Each conductor portion of each wire 120 has a soldering section 122 with an exposed metal core or conductor portion, and other conductor portions that are wrapped by the insulating layer such as a plastic layer or insulating paint-coating layer. That is, the wire 120 may be a plastic-covered wire, e.g., PVC-covered wire, or an enameled wire. When there are two or more wires 120 and the wires 120 are plastic-covered wires, the plurality of wires 120 may be connected side by side (parallel) via the plastic insulating layers to form a single wire assembly 120.

As shown in FIG. 1, FIG. 2 and FIG. 3, the LED 130 has a light emitting surface 132 and a soldering surface 134. A soldering pad is arranged on the soldering surface 134, and is used for soldering the LED 130 onto the soldering sections 122 of the wires 120, and the soldering surface 134 faces the wires 120.

As shown in FIG. 1, FIG. 2 and FIG. 3, a guide trench 114*a* is defined between the two guide pieces 114. The transparent adhesive 140 encapsulates or wraps around the soldering sections 122 of the wires 120 to affix the soldering sections 122 to the guide trench 114*a* and two lugs or flanges 116 of the light-transmitting cap 110, and extends to wrap around the light emitting surface 132 of the LED 130. The light-transmitting cap 110 covers the LED 130, so that the LED 130 is located at the opening 112*a*, and the light emitting surface 132 faces the interior of the body 112. Meanwhile, the transparent adhesive 140 attaches the LED 130 and the soldering sections 122 to the light-transmitting cap 110, so as to fix the light-transmitting cap 110 to the wires 120.

As shown in FIG. 1, FIG. 2 and FIG. 3, the two guide pieces 114 of the light-transmitting cap 110 are arranged in parallel and protrude from the bottom of the body 112, and the guide trench 114*a* is defined between the two guide pieces 114. The opening 112*a* is located between the two guide pieces 114, that is, the opening 112*a* is located in the guide trench 114*a*. The body 112 further includes a flange that includes two lugs 116 that inversely extend outward from the edge of the bottom of the body 112, and the two lugs 116 correspond to two ends of the guide trench 114*a*. In an embodiment, a distance between two ends of the two lugs 116 must be equal to or greater than a length of the soldering sections 122, so that the two lugs 116 may cover the whole soldering sections 122 to allow the transparent adhesive 140 to affix the soldering sections 122 and the wires 120 to the lugs 116.

The soldering sections 122 of the aforementioned wires 120 are located between the two guide pieces 114, and the transparent adhesive 140 may appropriately flow into the opening 112*a* and wrap around or contact the LED 130 to attach the soldering sections 122 of the wires 120 to the two guide pieces 114 and the edge of the opening 112*a*. The transparent adhesive 140 may use an adhesive or glue bulk with a curing function, such as an ultraviolet-curable adhesive that may be cured by ultraviolet radiation. Finally, the transparent adhesive 140 may exert a fixing or adhesive effect after being cured.

As shown in FIG. 1, FIG. 2 and FIG. 3, the two guide pieces 114 and the transparent adhesive 140 may achieve a movement-restricting effect on the soldering sections 122 in a horizontal direction, so as to avoid a soldering failure of the LED 130 due to bending of the soldering sections 122 in the horizontal direction. The two lugs 116 may achieve a movement-restricting effect on the soldering sections 122 in a vertical direction, so as to avoid the soldering failure of the LED 130 due to bending of the soldering sections 122 in the vertical direction.

Figure 4:
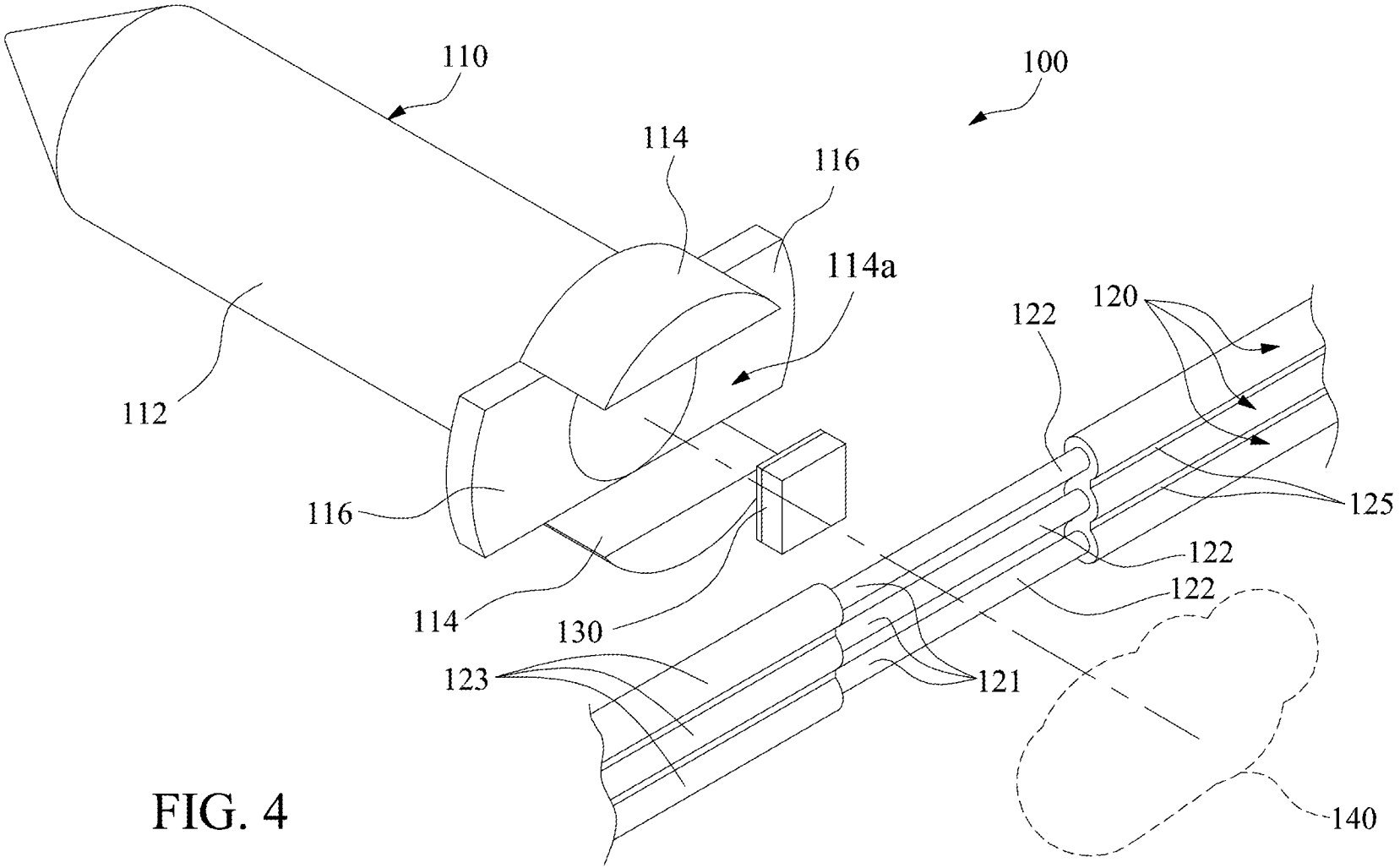
FIG. 4 is a three-dimensional exploded diagram of another embodiment of this disclosure.
Figure 5:
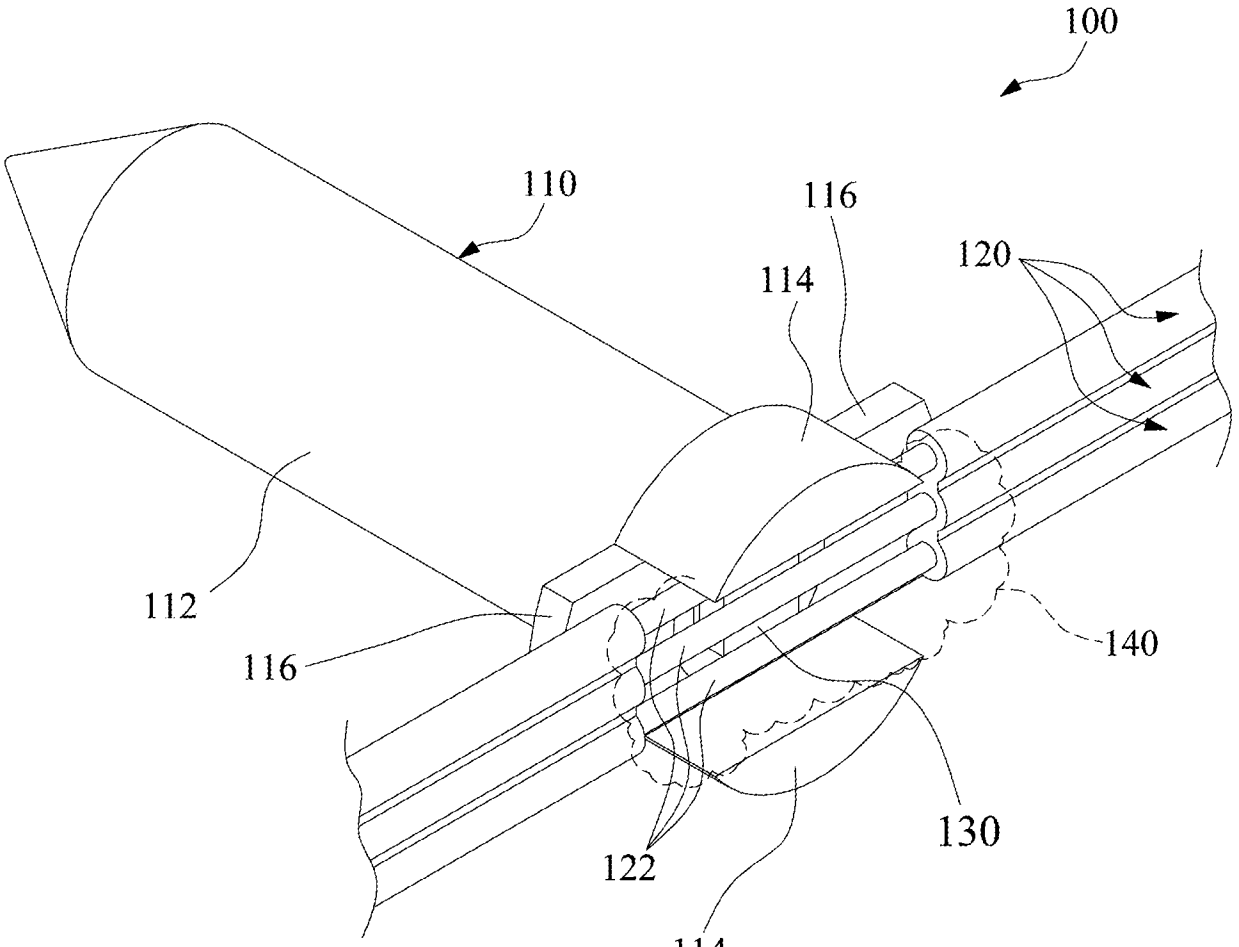
FIG. 5 is a three-dimensional diagram of another embodiment of this disclosure.

As shown in FIG. 4 and FIG. 5, a lighting string package structure 100 disclosed by another embodiment of this disclosure is illustrated. As shown in the figure, the thickness and width of two lugs 116 may vary, as long as a distance between two ends of the two lugs 116 is equal to or greater than a length of a soldering section 122 to allow the two lugs 116 to cover the whole soldering section 122.

Figure 6:
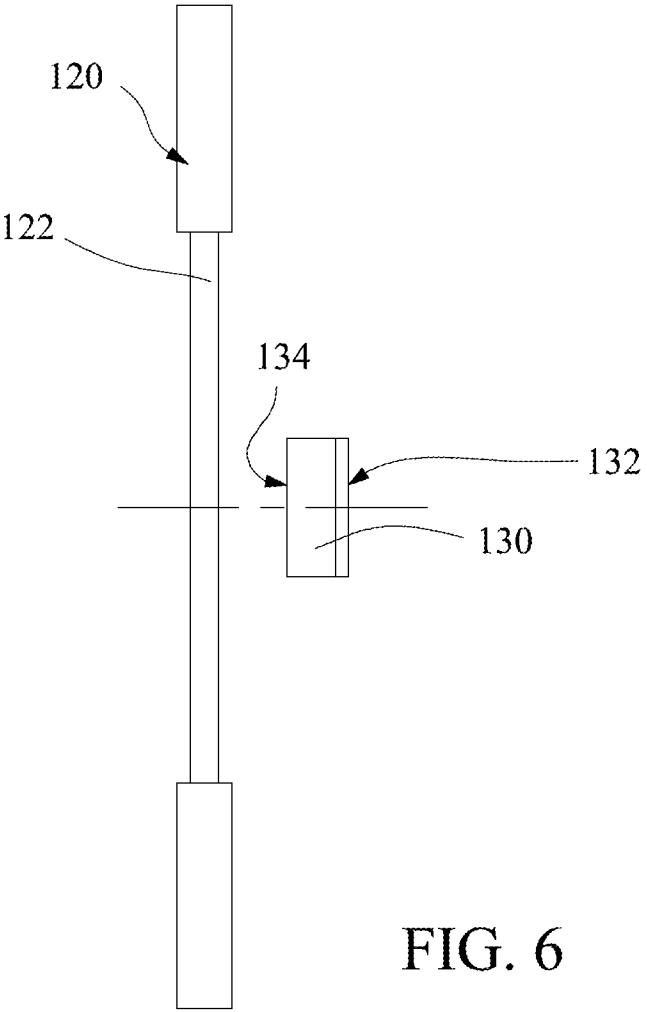
FIG. 6 and FIG. 7 are cross-sectional schematic diagrams of an embodiment of this disclosure, illustrating a processing method of a lighting string package structure.
Figure 7:
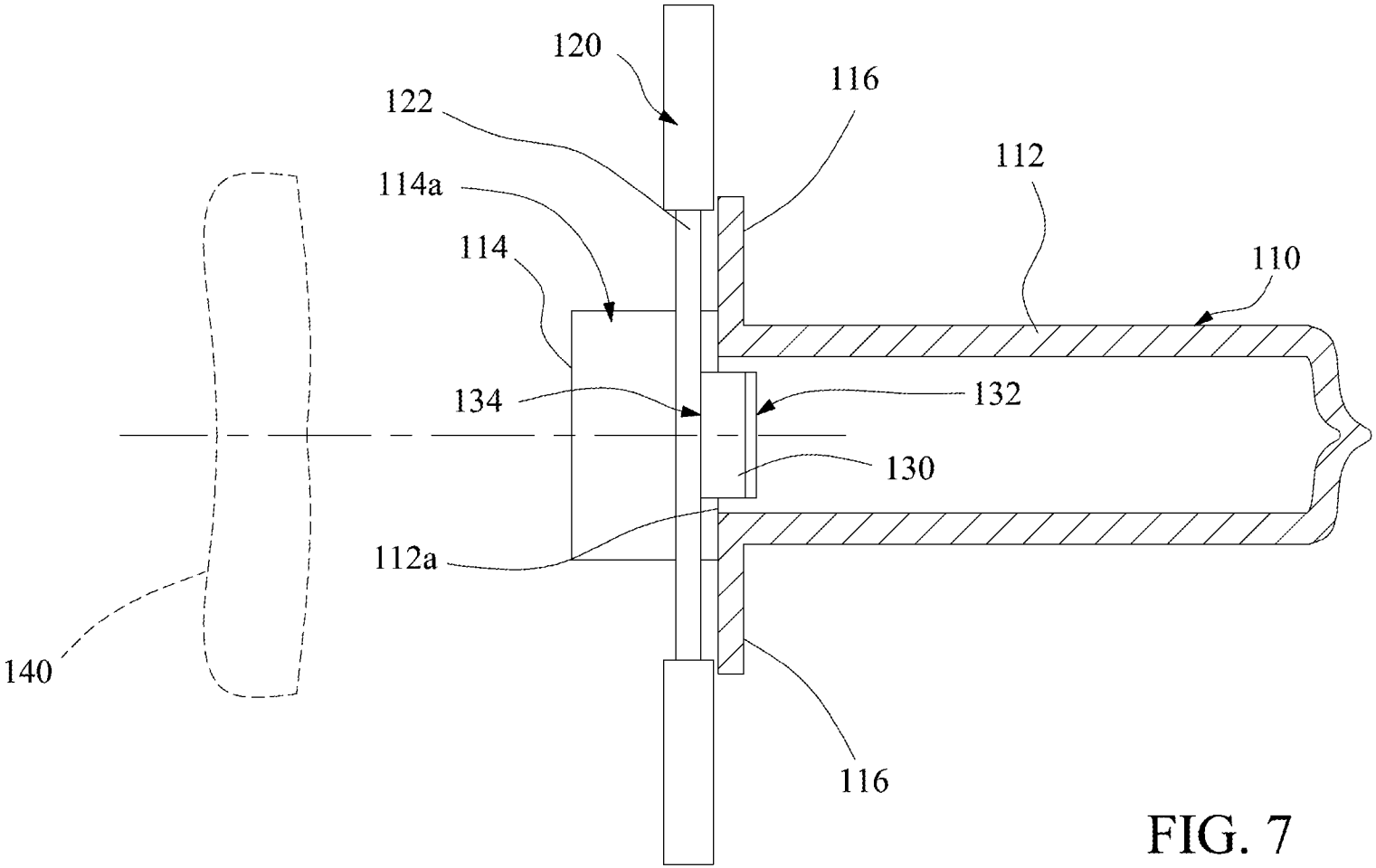
Figure 8:
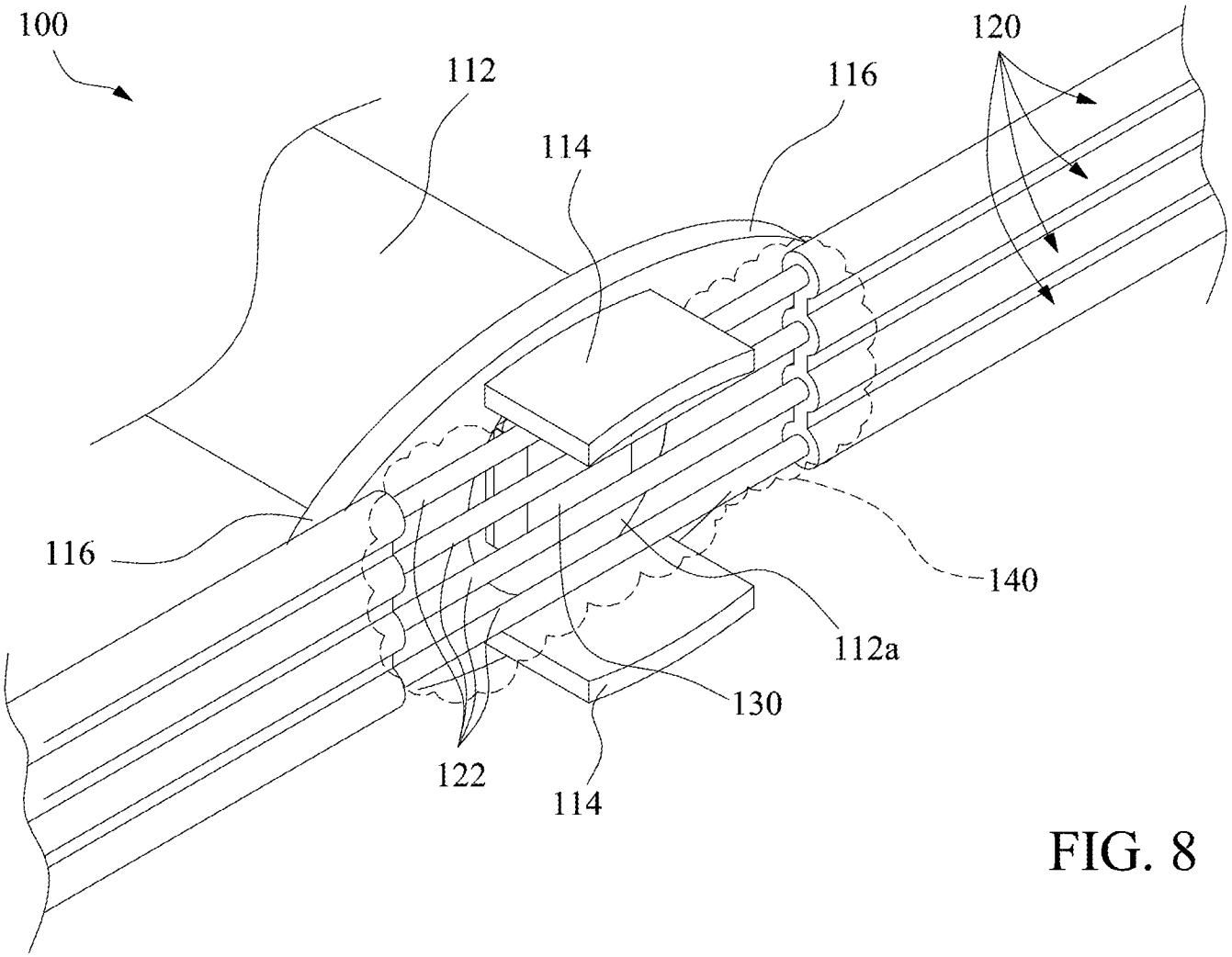
FIG. 8 and FIG. 9 are three-dimensional diagrams of different application cases of this disclosure.

As shown in FIG. 6, FIG. 7 and FIG. 8, an assembling method of a lighting string package structure 100 of this disclosure is illustrated.

As shown in FIG. 6, firstly, one or more wires 120 are prepared, and portions of insulating layers 123 such as plastic layers or insulating paint coating layer are removed by means of stripping, burning or grinding, cutting under tension, and so on, so as to form soldering sections 122. Secondly, a soldering surface 134 of a LED 130 is soldered to the soldering sections 122, the soldering sections 122 are flatly attached to the soldering surface 134, and a light emitting surface 132 faces a direction away from the soldering sections 122.

As shown in FIG. 7, an opening 112*a* of a body 112 is aligned with the LED 130, and the bottom of the body 112 covers the LED 130, so that the LED 130 is located at the opening 112*a*, and the light emitting surface 132 faces the interior of the body 112. Meanwhile, the wires 120 are located between two guide pieces 114.

As shown in FIG. 7, a transparent adhesive 140 is coated on a guide trench 114*a* and two lugs 116 so as to wrap the whole soldering sections 122. Furthermore, the transparent adhesive 140 may appropriately overflow to be attached between the edge of the opening 112*a* and the LED 130, between the soldering sections 122 and the two guide pieces 114, as well as between the soldering sections 122 and the bottom of the body 112.

As shown in FIG. 8, finally, the transparent adhesive 140 is cured. For example, an ultraviolet-curable adhesive is irradiated by ultraviolet radiation to complete the lighting string package structure 100. A plurality of soldering sections 122, LEDs 130 and light-transmitting caps are continuously disposed on the wires 120 to form a lighting string. The aforementioned procedure of disposing the plurality of soldering sections 122, LEDs 130 and light-transmitting caps may be a one-by-one arrangement or batch operation. For example, the soldering sections 122 are produced in batches, the LEDs 130 are soldered in batches, the light-transmitting caps are arranged in a coverage manner in batches, and gluing and curing are performed in batches.

Figure 9:
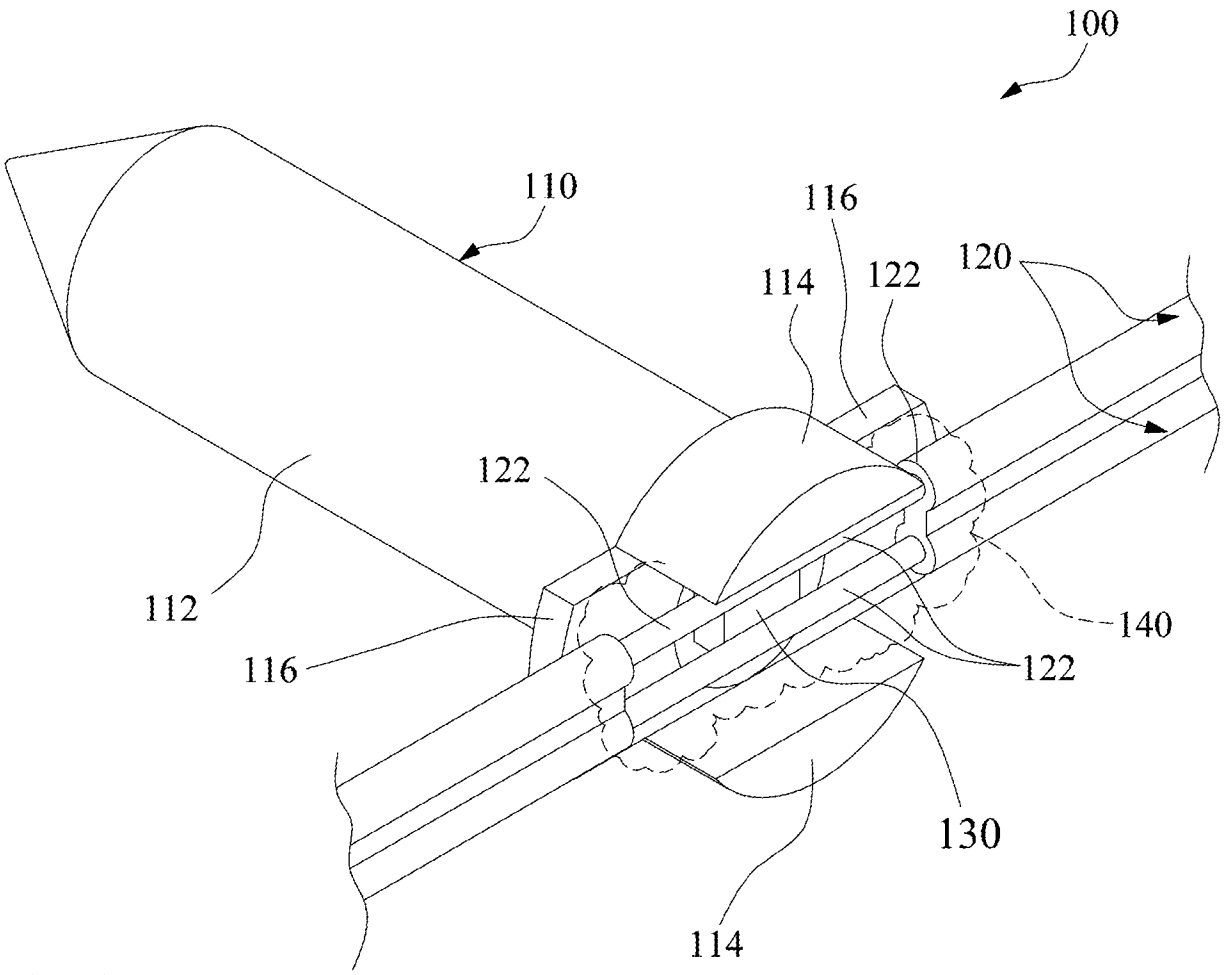

As shown in FIG. 8 and FIG. 9, in the first and second embodiments of this disclosure, the quantity of the wires 120 is not limited, that is, there may be two, three, four or an any quantity of wires, as long as the soldering sections 122 are located between the two guide pieces 114, and the transparent adhesive 140 attaches the LED 130 to the light-transmitting cap 110.

Figure 10:
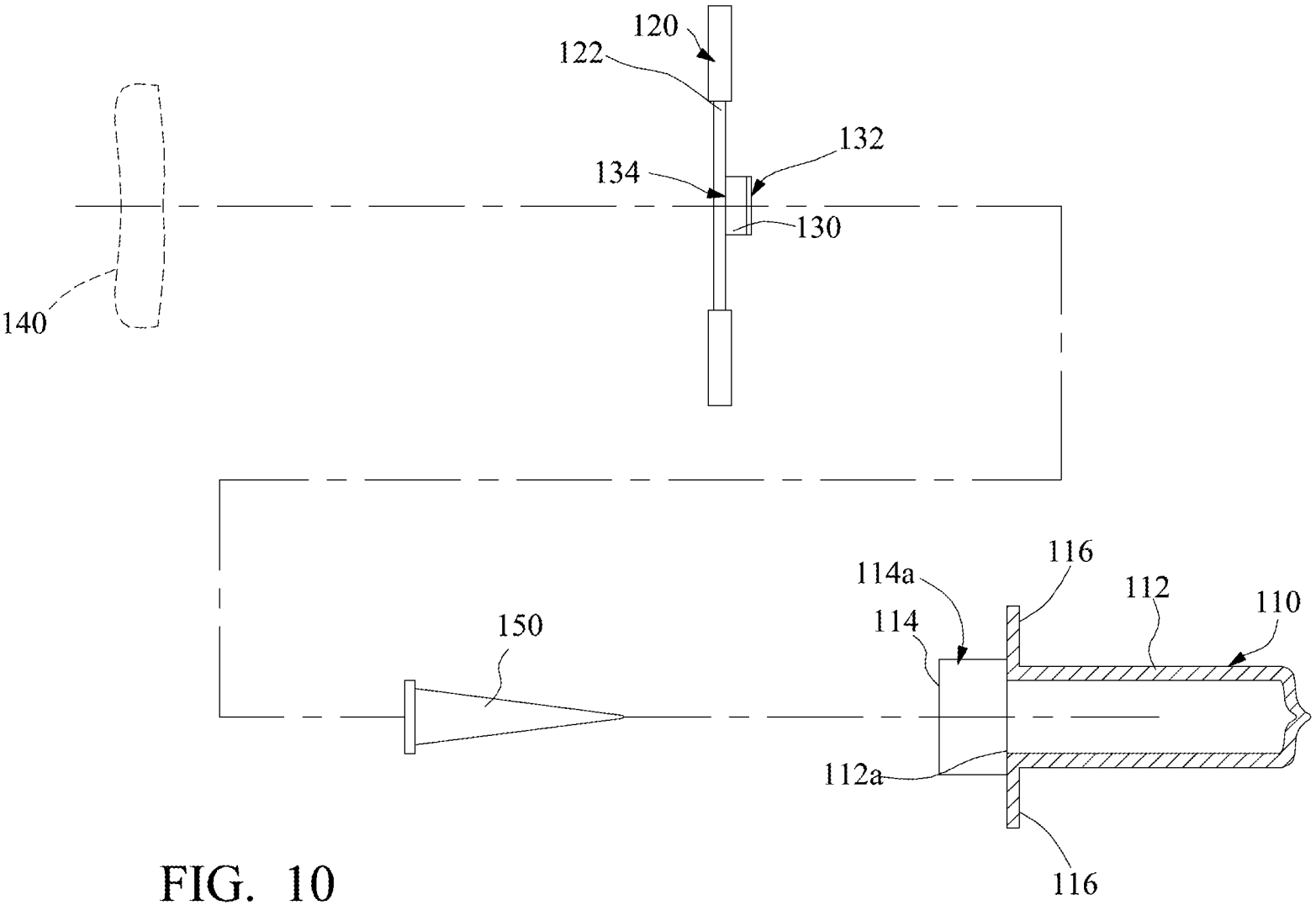
FIG. 10 is a cross-sectional exploded diagram of different application cases of this disclosure.
Figure 11:
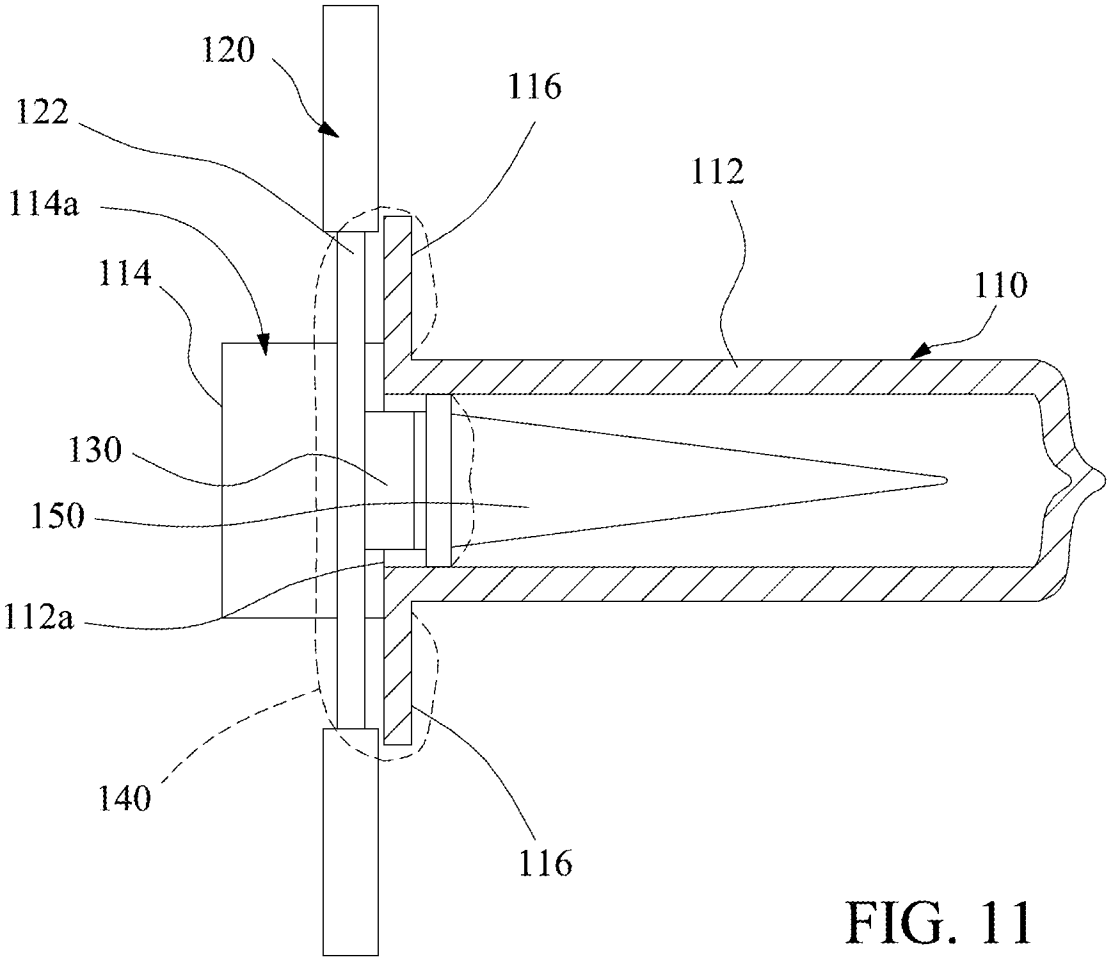
FIG. 11 to FIG. 13 are cross-sectional exploded diagrams of different application cases of this disclosure.

As shown in FIG. 10 and FIG. 11, in the first and second embodiments of this disclosure, the lighting string package structure 100 may further include a light guide 150. The light guide 150 is received into the body 112 through the opening 112*a*, and has one end facing the LED 130 to receive light and one end extending towards the front end of the body 112. The transparent adhesive 140 may appropriately overflow to be attached between the light guide strip 150 and the body 112 to fix the light guide strip 150.

Figure 12:
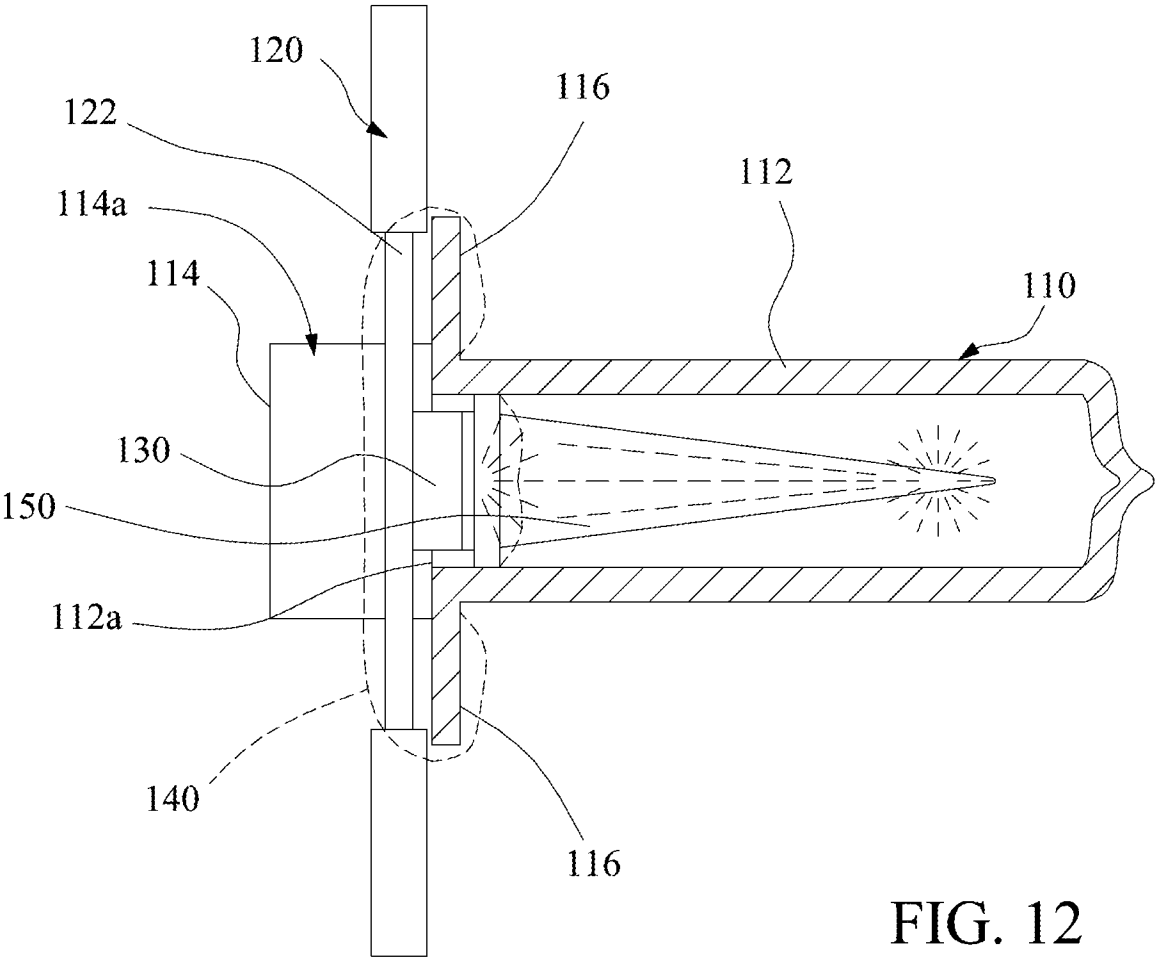

As shown in FIG. 12, when the LED 130 emits light, the light may be guided by the light guide 150 and uniformly emitted from the body 112 via the light guide 150, such that light emissions are concentrated at the opening 112*a*.

Figure 13:
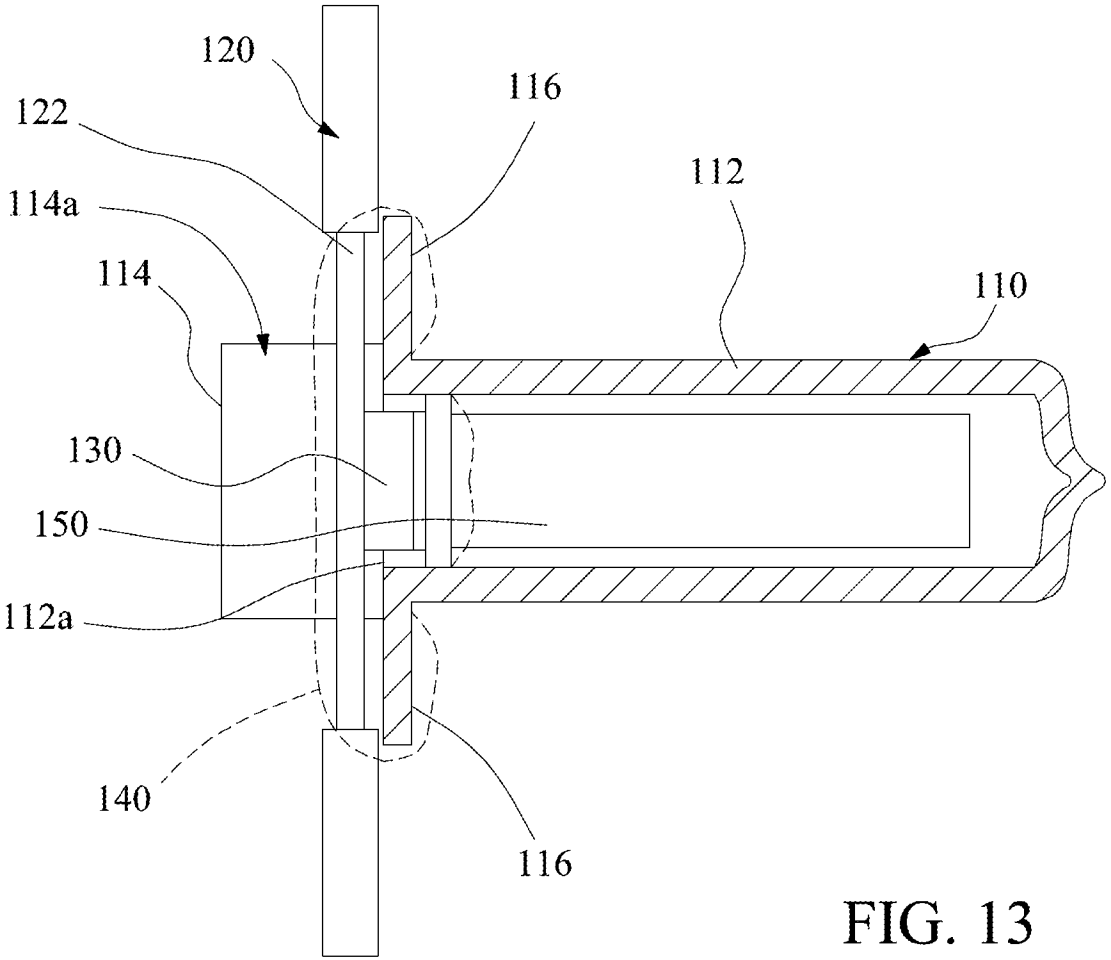

Referring to FIG. 13, the light guide 150 may be a cone or a cylinder, or may comprise columns with other cross section forms, as long as one end of the light guide 150 faces the LED 130 to receive the light, and the other end of the light guide strip 150 extends towards the front end of the body 112. In an embodiment, light guide 150 is a substantially solid structure, though in other embodiments, light guide 150 may include hollow portions to achieve a transmissive lighting effect that differs from a solid-material light guide.

By adopting the lighting string package structure 100, in addition to providing an optical effect through the light-transmitting cap, the fixing of the soldering sections 122 can be reinforced, thereby avoiding the soldering failure of the LED 130 due to the excessive bending of the soldering sections 122 in a use process of a lighting string.

In other embodiments, wire conductors may be bent, and in some cases, bent prior to adding the LED onto the conductors, in a manner that avoids stressing soldering sections, while at the same time, moving the LED upwards and away from the wires and further into the light-transmitting cap, so as to improve the illumination effect of the light structure and light string. Embodiments of such lighting structures and related lighting strings are described further below with respect to FIGS. 14 to 28. With respect to FIGS. 17-22, certain dimensions indicating lengths, widths and heights of various structures are included. It will be understood that these dimensions describe certain embodiments, and are not intended to limit the invention to only these dimensions.

Figure 14:
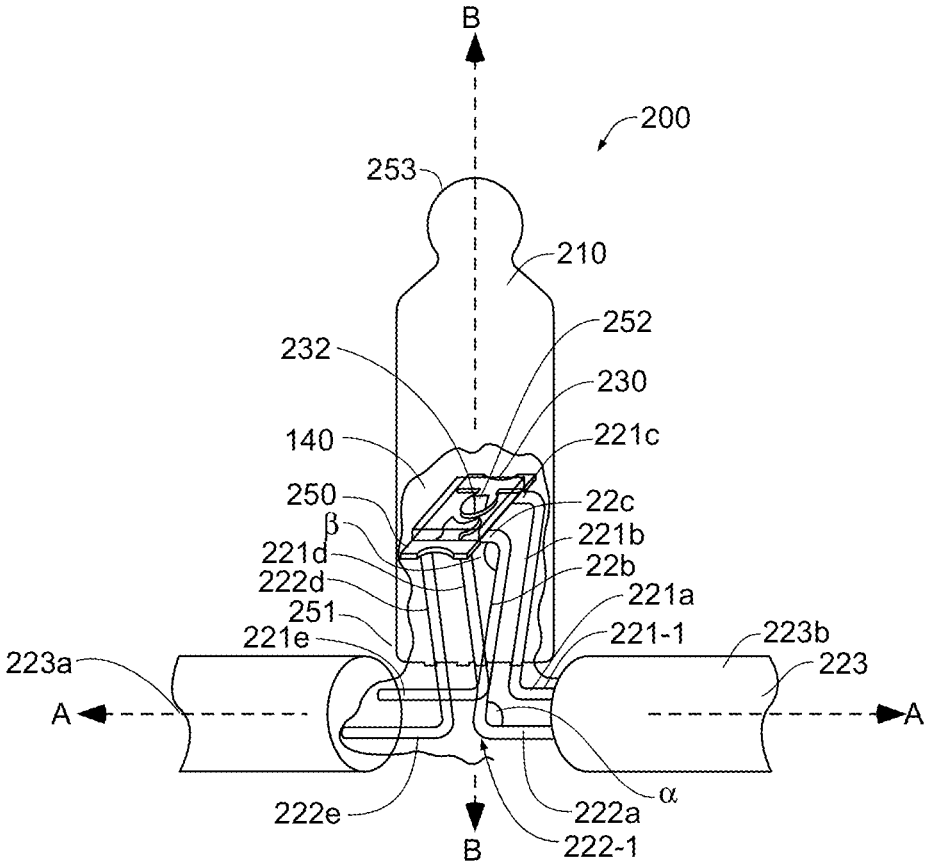
FIG. 14 is a perspective view of a lighting structure, according to another embodiment of the disclosure.
Figure 15:
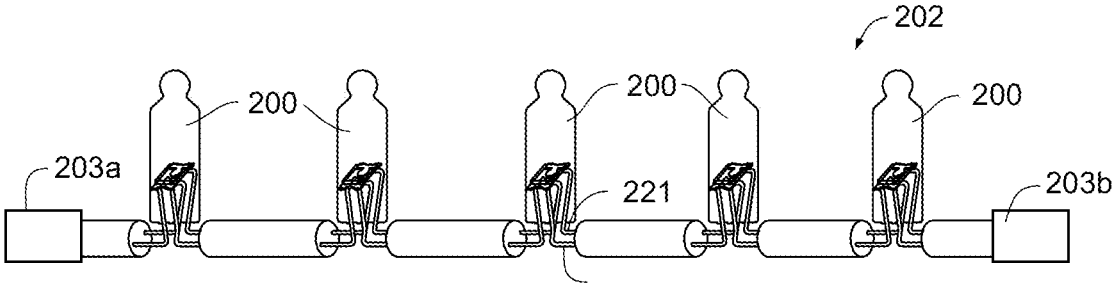
FIG. 15 is a perspective view of a lighting string, according to another embodiment of the disclosure.

Referring to FIG. 14, an embodiment of lighting structure 200 is depicted. Referring also to FIG. 15, a plurality of lighting structures 200 may be combined to form lighting string 202, that may include power connectors 203, which in an embodiment includes power connector/plug 203*a* and power end connector 203*b*.

Referring specifically to FIG. 14, in an embodiment, and as depicted, lighting structure 200 includes wire 220, LED assembly 230, light cap 210, and transparent adhesive 240.

Figure 16:
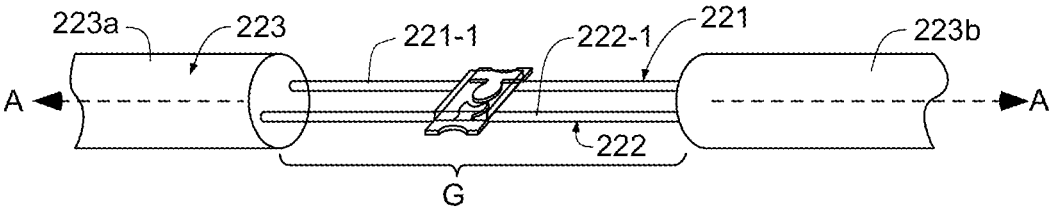
FIG. 16 is a perspective view of a wire with insulation and an LED assembly mounted to the wire conductors, prior to bending.

Wire 220 includes first conductor 221, second conductor 222, and insulation layer 223. Insulation layer 223 includes first insulation portion 223*a* that covers and insulates portions of first conductor 221 and second conductor 222, and includes second insulation portion 223*b*, the covers and insulates other portions of first and second conductors 221 and 222. Referring also to FIG. 16, which depicts LED assembly 230 mounted to conductors 221 and 222 prior to bending, insulation layer 223 does not cover conductor portions 221-1 of conductor 221 extending between insulation portions 223*a* and 223*b*, nor does insulation layer 223 cover conductor portions 222-1 of conductor 222 extending between insulation portions 223*a* and 223*b*. Insulation portions 223*a* and 223*b* form a gap G therebetween.

Referring specifically to FIG. 16, prior to bending, conductor portions 221-1 and 222-1 that are not insulated by insulation layer 223 extend horizontally along horizontal axis A.

Referring to FIG. 14, after bending, conductor portions 221-1 and 222-2 include a plurality of conductor segments. Conductor portion 221-1 includes conductor segment 221*a*, 221*b*, 222*c*, 222*d* and 222*e*; conductor portion 222-1 includes conductor segment 222*a*, 222*b*, 222*c*, 222*d* and 222*e*.

In an embodiment, and as depicted, conductor segments 221*a* and 222*a* extend outwardly and away from insulation portion 223*b*, and generally horizontally along axis A. Conductor segments 221*b* and 222*b* extend upwardly and away from segments 221*a* and 222*b*, respectively, and generally vertically along vertical axis B. Conductor segments 221*a* and 222*a* each form an angle α with conductor segments 221*b* and 222*b*, respectively. In an embodiment, angle α may be substantially 90°. In another embodiment, and as depicted, angle α may be less than 90°, as depicted. In an embodiment, angle α may be in a range of 60° to 90°, depending on various factors, including a diameter of light-transmitting cap 210. In other embodiments, angle α may be greater than 90°. In one such embodiment, angle α may be in a range of 90° to 120°

Conductor segments 221*c* and 222*c* extend horizontally and away from, and may form an angle β with, conductors segments 221*b* and 222*b*, respectively. In an embodiment, angle β is substantially 90°. In an embodiment, angle β may be in a range of 60° to 90°, depending on various factors, including a diameter of light-transmitting cap 210. In other embodiments, angle β may be greater than 90°. In one such embodiment, angle β may be in a range of 90° to 120°. In an embodiment, β is equal to 180° minus angle α, particularly when conductor segments 221*a*, 222*a*, 221*c* and 222*c* and horizontal.

Conductor segments 221*d* and 222*d* extend downwardly or vertically, and away from conductor segments 221*c* and 222*c*. Conductor segments 221*e* and 222*e* extend horizontally and away from conductor segments 221*d* and 222*d*.

Figure 17:
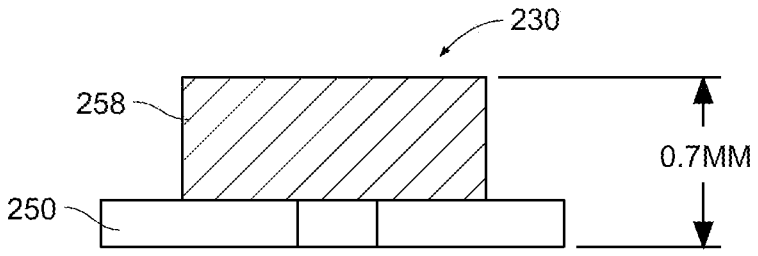
FIG. 17 is a right-side view of an LED assembly of a lighting structure, according to an embodiment of the disclosure.
Figure 18:
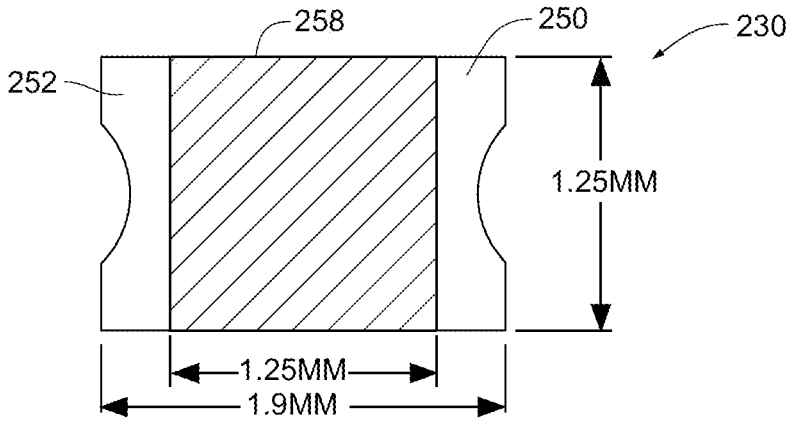
FIG. 18 is a top view of the LED assembly of FIG. 17.
Figure 19:
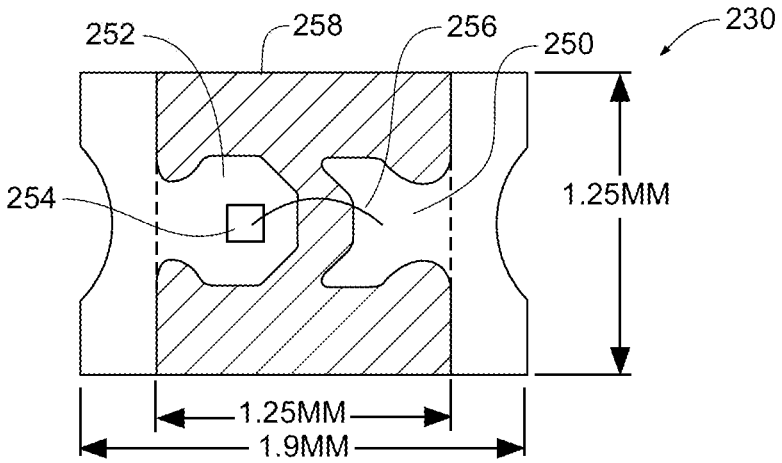
FIG. 19 is a top view of the LED assembly of FIG. 18, with a portion of an LED lens removed to expose the anode and cathode terminals of the LED assembly.
Figure 20:
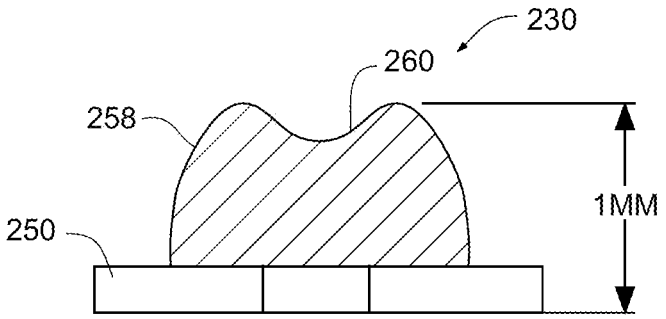
FIG. 20 is a right-side view of another LED assembly of a lighting structure, according to another embodiment of the disclosure.
Figure 21:
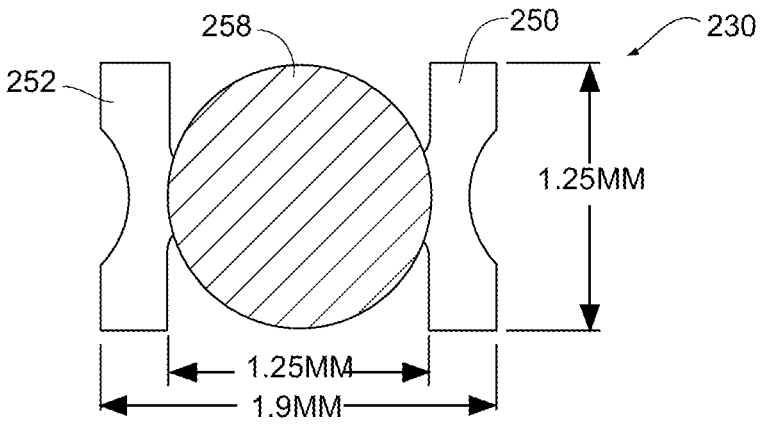
FIG. 21 is a top view of the LED assembly of FIG. 20.
Figure 22:
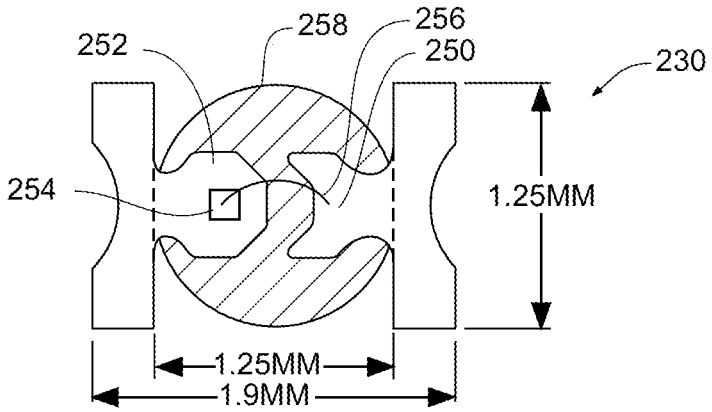
FIG. 22 is a top view of the LED assembly of FIG. 21, with a portion of an LED lens removed to expose the anode and cathode terminals of the LED assembly.

Referring also to FIGS. 17-19, and embodiment of LED assembly 230 is depicted. FIGS. 20-22 depict another embodiment of LED assembly 230. Other embodiments of LEDs that may be used with light string 202 are described above with respect to FIGS. 1-13.

FIG. 17 is a side view of LED assembly 230; FIG. 18 is a top view of LED assembly 230; and FIG. 19 is a top view of the LED assembly 230 of FIG. 18 with the lens cut away to expose the electrical terminals. In an embodiment, LED assembly 230 is sized per the dimensions provided, though in other embodiments, LED assembly 230 may be larger or smaller, dependent in part on sizing of light-transmitting cap 210.

In an embodiment, LED assembly 230 includes a generally flat lead frame with positive/anode terminal 250 and negative/cathode terminal 252. LED assembly 230 also includes light-emitting diode (LED) 254, which may comprise a semiconductor LED chip, wire 256 and lens 258. LED 254 is conductively mounted to cathode terminal 252 such that a cathode of LED 254 is in electrical connection with cathode terminal 252; wire 256 electrically connects an anode of LED 254 to anode terminal 250.

Lens 258 may comprise epoxy material, or other transparent or semi-transparent material, as is known in the art. In an embodiment, lens 258 is generally square or rectangular in a top view, and in a side view.

Another embodiment of LED assembly 230 having a circular lens 258 is depicted in FIGS. 20-22.

Similar to LED assembly 230 of FIGS. 17-19, LED assembly 230 of FIGS. 20-22 also includes a generally flat lead frame with positive/anode terminal 250 and negative/cathode terminal 252. LED assembly 230 also includes light-emitting diode (LED) 254, which may comprise a semiconductor LED chip, wire 256 and lens 258. LED 254 is conductively mounted to cathode terminal 252 such that a cathode of LED 254 is in electrical connection with cathode terminal 252; wire 256 electrically connects an anode of LED 254 to anode terminal 250.

Lens 258 may comprise epoxy material, or other transparent or semi-transparent material, as is known in the art. In this embodiment, lens 258 is generally circular in a top view (FIG. 21). Top surface 260 of lens 258 may form a concave surface as depicted.

Referring again to FIGS. 14 and 16, LED assembly 230 is mounted to conductors 221 and 222, and more specifically to conductor portions 221-1 and 222-1. Anode terminal 252 is electrically connected, which may be via soldering, to conductor portion 222*c*, and cathode terminal 250 is electrically connected to conductor portion 221*c*, thereby electrically connecting LED assembly 230 to conductors 221 and 222.

Referring specifically to FIG. 14, transparent adhesive 240 may be used to cover and insulate portions of lighting structure 200. Transparent adhesive 240 also provides structural support and stability to lighting structure 200. In an embodiment, and as depicted, transparent adhesive 240 may coat and cover LED assembly 230, conductor portions 221-1 and 222-1, and portions of wire insulation portions 223*a* and 223*b*. When cured, transparent adhesive 240 holds and stabilizes bent portions of conductor portions 221-1 and 222-1, so as to prevent movement of these conductor portions, and hold the bent shape. Transparent adhesive 240 also provides a degree of electrical insulation to exposed conductor portions.

Light transmission cap 210 is placed over LED assembly 230, portions of conductor portions 221-1 and 222-1, and a portion of transparent adhesive 240. In an embodiment, light transmission cap 210 is placed over these components prior to transparent adhesive 240 being cured, and curing is accomplished with UV light exposure with light transmission cap 210 in place. In another embodiment, transparent adhesive 240 on LED assembly 230 and conductor portions 221-1 and 222-1 is cured, then cap 210 is added, then more transparent adhesive 240 is added so as to secure cap 210 to lighting structure 200.

As such, LED assembly 230 is above the horizontal plane in which conductor portions 221*e* and 222*e* reside in. Raising LED assembly 230 above wire 220, and out of gap G makes the light more visible to a user, and avoids obstruction by wire insulation 223. Defining a height of light-transmitting cap as H, and extending from a bottom end 251 of cap 210 to top end 253 of cap 210, in an embodiment, LED assembly 230 is located approximately ⅓ of the distance H from bottom end 251 and 70% from top end 253. In another embodiment, LED assembly 230 is located approximately halfway between bottom end 251 and top end 253. In another embodiment, LED assembly 230 is located in the middle 50% of cap 210, i.e., between 25% and 75% of the distance of H from either bottom end 253 or top end 251.

Referring to FIG. 15, as briefly described above, multiple lighting structures 200 can be combined to form lighting string 202. Lighting structures 200 and their respective LED assemblies 230 may be electrically connected in parallel, as depicted in FIG. 15, wherein conductors 221 and 222 are continuous from connector 203*a* to 203*b*. In other embodiments, LED assemblies 230 are electrically connected in a series-parallel connection, with groups of LED assemblies 230 connected in series, with individual LED assemblies 230 within a group being electrically connected in parallel. In such an embodiment, conductors 221 and 222 may have one or more discontinuities between groups to form the series connections between groups of LED assemblies 230.

Figure 23:
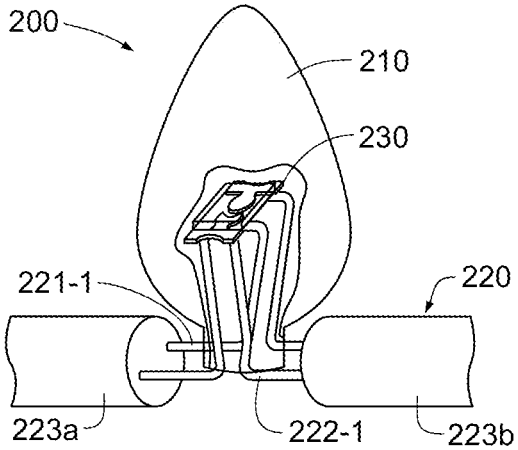
FIG. 23 is a perspective view of a lighting structure that includes a candelabra-style light-transmitting cap.

Referring to FIG. 23, another embodiment of lighting structure 200 is depicted. In this embodiment, lighting structure 200 is substantially the same as the lighting structure 200 described above with respect to FIGS. 14-22.

However, in this embodiment of FIG. 23, lighting structure 200 includes a light-transmitting cap 210 that is not primarily cylindrical, as is light cap 210 of FIG. 14, but rather, is in the shape of a candelabra, or "C" bulb. In this embodiment, LED assembly 230 is ideally located within C-style light-transmission cap 210 at a widest point of cap 210.

Figure 26:
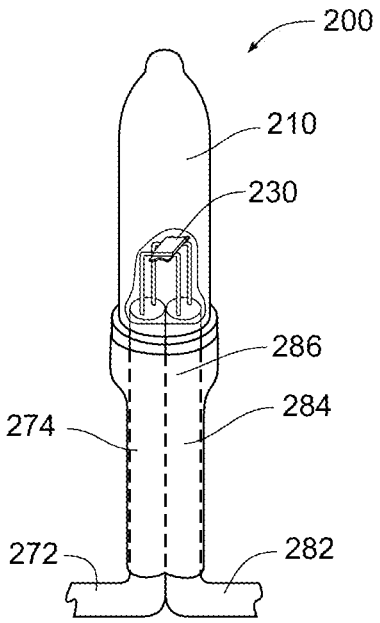
Figure 27:
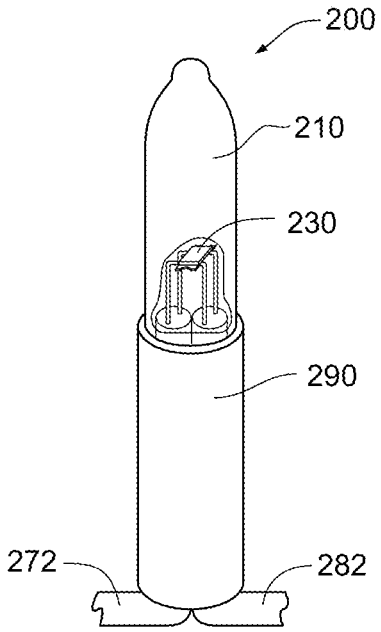
Figure 28:
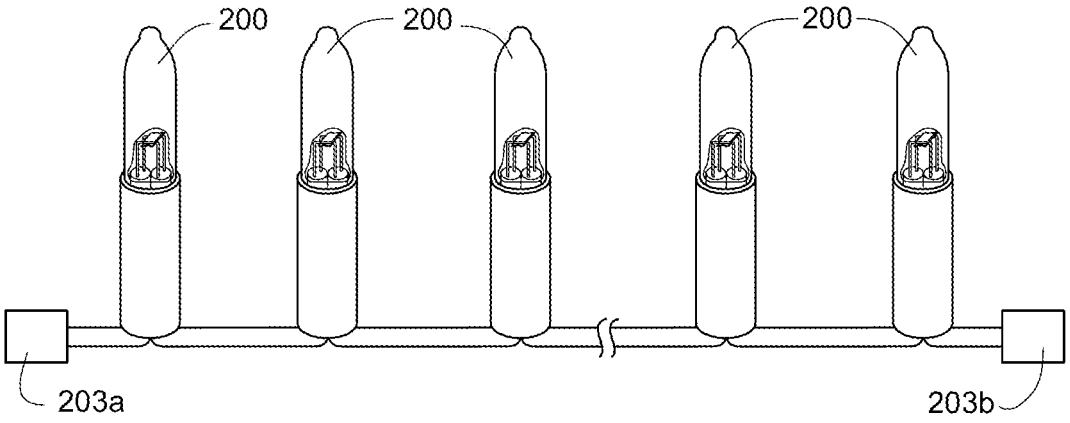
FIG. 28 is a perspective view of a lighting string that includes the lighting structure of FIGS. 24-27.

Referring to FIGS. 24-27, another embodiment of a lighting structure 200 is depicted, and in FIG. 28, an embodiment of a lighting string 202 is depicted. Lighting structure 200 of FIGS. 24-28 is similar to the lighting structures described above with respect to FIGS. 14-23, however, in the embodiment of FIGS. 24-27, portions of insulated wire 200 are received into light-transmitting cap 210, and an insulate portion of wire 200 is bent.

Figure 24:
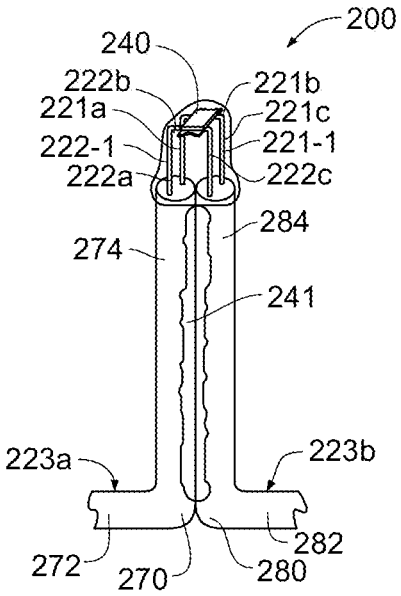
FIGS. 24-27 are perspective views of a lighting structure, according to additional embodiments of the disclosure.
Figure 25:
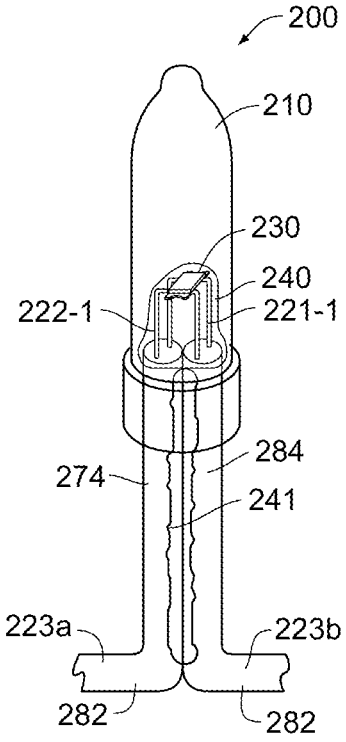

Referring specifically to FIGS. 24 and 25, in an embodiment lighting structure 200 includes first insulated wire portion 223*a*, second insulated wire portion 223*b*, conductor portion 221-1, conductor portion 222-1, LED assembly 230, transparent adhesive 240, adhesive 241 and light-transmitting cap 210.

In an embodiment, first insulated wire portion 223*a* is bent at corner 270 to form first horizontal insulated wire portion 272 and first vertical insulated wire portion 274. In an embodiment, bent corner 270 forms an approximately 90° angle, though in other embodiments bent angle 270 may be larger or smaller than 90°. However, a 90° angle may facilitate adhering of wire portions, as described further below. Second insulated wire portion 223*b* is bent at corner 280 to form second horizontal insulated wire portion 282 and second vertical insulated wire portion 284. In an embodiment, bent corner 280 forms an approximately 90° angle, though in other embodiments bent angle 270 may be larger or smaller than 90°.

In an embodiment, all or portions of first vertical insulated wire portion 272 and second vertical insulated wire portion 282 are adhered together using adhesive 241. In an embodiment, adhesive 241 is the same as adhesive 240. In other embodiments, adhesive 241 may comprise other adhesives, glues, and so on.

Conductor portions 221-1 and 222-1 are not covered with insulation 223, including not being covered by insulation portions 223*a* or 223*b*. Conductor portion 221-1 includes first vertically-extending conductor portion 221*a*, horizontally-extending portion 221*b*, and second vertically extending conductor portion 221*c*. First vertically-extending conductor portion 221*a* extends out of the insulation of first vertical insulated wire portion 274, and second vertically-extending portion 221*c* extends out of the insulation of second vertical extending wire portion 284. Horizontally-extending portion 221*b* connects first and second vertically-extending portions 221*a* and 221*c*.

Conductor portion 222-1 includes first vertically-extending conductor portion 222*a*, horizontally-extending portion 222*b*, and second vertically extending conductor portion 222*c*. First vertically-extending conductor portion 222*a* extends out of the insulation of first vertical insulated wire portion 274, and second vertically-extending portion 222*c* extends out of the insulation of second vertical extending wire portion 284. Horizontally-extending portion 221*b* connects first and second vertically-extending portions 221*a* and 221*c*.

LED assembly 230 is mounted to horizontally-extending portions 221*b* and 222*b*, thereby electrically connecting LED assembly 230 to conductors 221 and 222.

Transparent adhesive 240 covers LED assembly 230 and conductor portions 221-1 and 222-2, stabilizing and securing the position of LED assembly 230 and conductor portions 221-1 and 222-1.

Light-transmitting cap 210 is placed over LED assembly 230, conductor portions 221-1 and 222-1, transparent adhesive 240, and end portions of first vertical insulated wire portion 272 and second vertical insulated wire portion 282, such that these components are received into a cavity of cap 210.

Referring to FIG. 26, in an embodiment of lighting structure 200, binding wrap 286 may be used to connect and bind first vertical wire portion 274 and second vertical wire portion 274. Binding wrap 286 may comprise a shrink wrap material, a flexible sleeve, or similar, and may be used in place of adhesive 241, or may be used in addition to adhesive 241.

Referring to FIG. 27, in an embodiment of lighting structure 200, solid sleeve 290 may be used to cover or connect and bind first vertical wire portion 274 and second vertical wire portion 274. Solid sleeve 290 may comprise a polymer material, such as PE, PET of PVC, define a cylindrical shape, and may be used in place of adhesive 241 wrap 286, or may be used in addition to adhesive 241 and/or wrap 286.

Referring to FIG. 28, a plurality of lighting structures 200 according to the embodiments of FIGS. 24-27 may be used to make a light string 202 that includes multiple lighting structures 200 and optional connectors 203*a* and 203*b*, similar to the lighting strings 202 described above.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A lighting structure, comprising:

a first conductor having a first insulated portion, a second insulation portion and a first conductor portion therebetween, the first conductor portion being bent so as to form a first horizontal portion and two first vertical portions;

a second conductor having a first insulated portion, a second insulation portion and a second conductor portion therebetween, the second conductor portion being bent so as to form a first horizontal portion and two first vertical portions;

an LED assembly connected to the first horizontal portions of the first and second conductors;

a transparent adhesive covering the LED assembly and the first conductor portions of the first and second conductors; and a light-transmitting cap covering the LED assembly and the first horizontal portions of the first and second conductors.

2. A light string comprising a plurality of the lighting structures of claim 1.

* * * * *